US009491973B2

(12) United States Patent
Reed

(10) Patent No.: US 9,491,973 B2
(45) Date of Patent: Nov. 15, 2016

(54) METHOD OF AIR HUMIDIFICATION AND INJECTION DELIVERY

(71) Applicant: Keith S. Reed, East Brunswick, NJ (US)

(72) Inventor: Keith S. Reed, East Brunswick, NJ (US)

( * ) Notice: Subject to any disclaimer, the term of this patent is extended or adjusted under 35 U.S.C. 154(b) by 0 days.

(21) Appl. No.: 14/946,632

(22) Filed: Nov. 19, 2015

(65) Prior Publication Data

US 2016/0128383 A1 May 12, 2016

Related U.S. Application Data

(62) Division of application No. 14/083,022, filed on Nov. 18, 2013, now abandoned.

(51) Int. Cl.
*B01F 3/04* (2006.01)
*A24F 25/02* (2006.01)

(52) U.S. Cl.
CPC ..... *A24F 25/02* (2013.01)

(58) Field of Classification Search
CPC ..... A24F 25/02
USPC ..... 261/121.1; 131/303, 329
See application file for complete search history.

(56) References Cited

U.S. PATENT DOCUMENTS 3,885,930 A * 5/1975 Scheerer ..... B01D 19/0042 261/121.1
4,450,118 A * 5/1984 Tuin ..... B01J 4/008 261/119.1
4,597,917 A * 7/1986 Lunsford ..... A61M 16/1075 128/200.11
5,400,612 A 3/1995 Hedges
5,556,579 A 9/1996 Newman
5,651,262 A 7/1997 Pendergast
5,687,749 A 11/1997 Brauer
5,702,648 A 12/1997 White
5,741,444 A 4/1998 Kasuli
5,816,264 A 10/1998 Sebastiani
5,829,452 A 11/1998 Oster
5,842,597 A 12/1998 Kraus
5,881,868 A 3/1999 Soyak
5,884,632 A 3/1999 Brauer
5,901,710 A 5/1999 Barber
(Continued)

FOREIGN PATENT DOCUMENTS

DE 10 2010 031 019 A1 * 1/2012

OTHER PUBLICATIONS cigarhumidifier.org. Full Cigar Humidifier Guide. Website. Nov. 15, 2013. Retrieved from http://cigarhumidifier.org/full-cigar-humidifier-guide/.

(Continued)

*Primary Examiner* — Charles Bushey

(57) ABSTRACT

The invention is a method of air humidification and injection delivery that humidifies air to a specific selected relative humidity and injects the humidified air into a container to establish the specific selected relative humidity throughout the container. The method includes the facilitation of ambient supply air into a liquid medium for humidification to a specific selected relative humidity. The resulting humidified air is released from the liquid medium and routed for injection into the container. The injected humidified air infiltrates the container and sustains the selected relative humidity throughout the container. Contents of the container are thus maintained at the selected relative humidity.

5 Claims, 2 Drawing Sheets

(56) References Cited

U.S. PATENT DOCUMENTS

| | | | | |
|---|---|---|---|---|
| 5,934,773 | A | 8/1999 | Ferrell | |
| 5,936,178 | A | 8/1999 | Saari | |
| 5,957,277 | A | 9/1999 | Elliott | |
| 5,957,380 | A | 9/1999 | Fitterman | |
| 5,957,554 | A | 9/1999 | Pendergast | |
| 5,975,288 | A | 11/1999 | Crowder | |
| 6,027,187 | A | 2/2000 | Siepmann | |
| 6,092,533 | A | 7/2000 | Moses | |
| 6,116,029 | A | 9/2000 | Krawec | |
| 6,122,918 | A * | 9/2000 | Johnson, Jr. | A24F 25/02 62/3.6 |
| 6,308,437 | B1 | 10/2001 | Villar | |
| 6,615,841 | B2 | 9/2003 | DeLoach | |
| 6,887,303 | B2 | 5/2005 | Hesse | |
| 6,921,026 | B2 | 7/2005 | Saari | |
| 7,591,881 | B2 | 9/2009 | Yeager | |
| 7,841,586 | B1 | 11/2010 | Mongeon | |
| 7,892,327 | B2 | 2/2011 | Neff | |
| 8,069,860 | B2 | 12/2011 | Soyak | |
| 8,087,645 | B2 | 1/2012 | Hepple | |
| 8,171,746 | B2 | 5/2012 | Miyauchi | |
| 8,211,209 | B2 | 7/2012 | Neff | |
| 8,220,782 | B2 | 7/2012 | Hepple | |
| 8,342,185 | B2 | 1/2013 | Egued | |
| 8,544,825 | B2 | 10/2013 | Lee | |
| 8,550,072 | B2 | 10/2013 | Thudor | |
| 2003/0042630 | A1 * | 3/2003 | Babcoke | B01F 3/04078 261/121.1 |
| 2004/0256745 | A1 * | 12/2004 | Simler | A61K 31/045 261/121.1 |
| 2007/0012796 | A1 * | 1/2007 | Pohl | A24F 25/02 239/34 |
| 2007/0039486 | A1 * | 2/2007 | Homsey | A21D 15/00 99/467 |

OTHER PUBLICATIONS

Cigaroasis. Humidifier Products. Website. Nov. 15, 2013. Retrieved from http://www.cigaroasis.com/products/humidifier-products.html.

Cigaroasis. Innovation. Website. Nov. 15, 2013. Retrieved from http://www.cigaroasis.com/company-info/innovation.html.

BCspecialties. Moist-n-Aire Electronic Cigar Humidifier. Website. Nov. 15, 2013. Retrieved from http://www.bcspecialties.com/c-18-moist-n-aire.aspx.

BCspecialties. Paradigm Cigar Humidifiers. Website. Nov. 15, 2013. Retrieved from http://www.bcspecialties.com/c-17-paradigm.aspx.

hydrahumidifier.com. Hydra Electronic Cigar Humidification. Website. Nov. 15, 2013. Retrieved from http://hydrahumidifier.com/default.asp.

Heartfelt Industries. Humidity Beads. Website. Nov. 15, 2014. Retrieved from http://www.heartfeltindustries.com/categories.asp?cat=Humidity+Beads.

* cited by examiner

METHOD OF AIR HUMIDIFICATION AND INJECTION DELIVERY

This application is a Divisional application of application Ser. No. 14/083,022, filed Nov. 18, 2013, now abandoned.

BACKGROUND OF THE INVENTION

Proper humidification is essential for cigars or other items that have storage recommendations requiring specific relative humidity levels. Passive methods of humidification include the natural evaporation of ambient moisture. In passive humidification methods, moisture naturally evaporates from a solid state medium, typically a porous membrane, such as a sponge or foam-type material, a fibrous grid or matrix, a hygroscopic salt, or a polymer designed to expand and contain moisture, as exhibited in U.S. Pat. Nos. 5,975,288; 7,892,327; 5,936,178; and 8,087,645 respectively. The rate of evaporation is not able to be controlled, thus a precise and consistent relative humidity cannot be achieved. Furthermore, the relatively slow rate of natural evaporation is not sufficient to rapidly establish a selected relative humidity in an enclosure, specifically a cigar humidor or other enclosure that is repeatedly opened and needs to be repeatedly humidified.

Active methods of humidification have been designed to accelerate natural evaporation. Existing practices of active humidification employ the use of a humidity sensor and a fan working in conjunction to accelerate the process of passive humidification, as exhibited in U.S. Pat. Nos. 5,400,612; and 5,651,262. The humidity sensor activates the fan at a set point, generating a release of humidified air with a non-specific relative humidity. The humidified air typically has a relative humidity level that is much higher than the set point at which the sensor is triggered. The humidified air is emitted until the set point of relative humidity is reached, as detected by the sensor, at which point the fan is deactivated. As humidity dissipates and the sensor detects a relative humidity level below the set point, the fan turns on and the emission of humidified air is reactivated. The result is an environment with a cyclic fluctuation of relative humidity and an atmosphere in which the relative humidity of a location is dependent on proximity to the fan or sensor of the humidification device.

A method that specifically controls the relative humidity of emitted air can actively establish and sustain a selected relative humidity inside a storage container. Humidity sensitive materials benefit from storage conditions that are not subject to the humidity variations associated with uncontrolled moisture release and proximity to the humidification source or sensor.

BRIEF SUMMARY OF THE INVENTION

The disclosed method of air humidification and injection delivery generates a source of air that is humidified to a specific selected relative humidity and injects the humidified air into a container, thus establishing and sustaining the selected level of relative humidity throughout the container. The continual injection of air that is humidified to a selected relative humidity maintains a stable storage environment inside the container. The method is intended for, but not limited to, the storage and preservation of tobacco products, specifically cigars, or other botanicals, organisms, pharmaceuticals, minerals, chemical preparations, or other specialty items that benefit from an environment that has a specific level of relative humidity. The disclosed method of air humidification and injection delivery is specifically advantageous in the cigar industry for maintaining cigars at a selected relative humidity.

Figure 1:
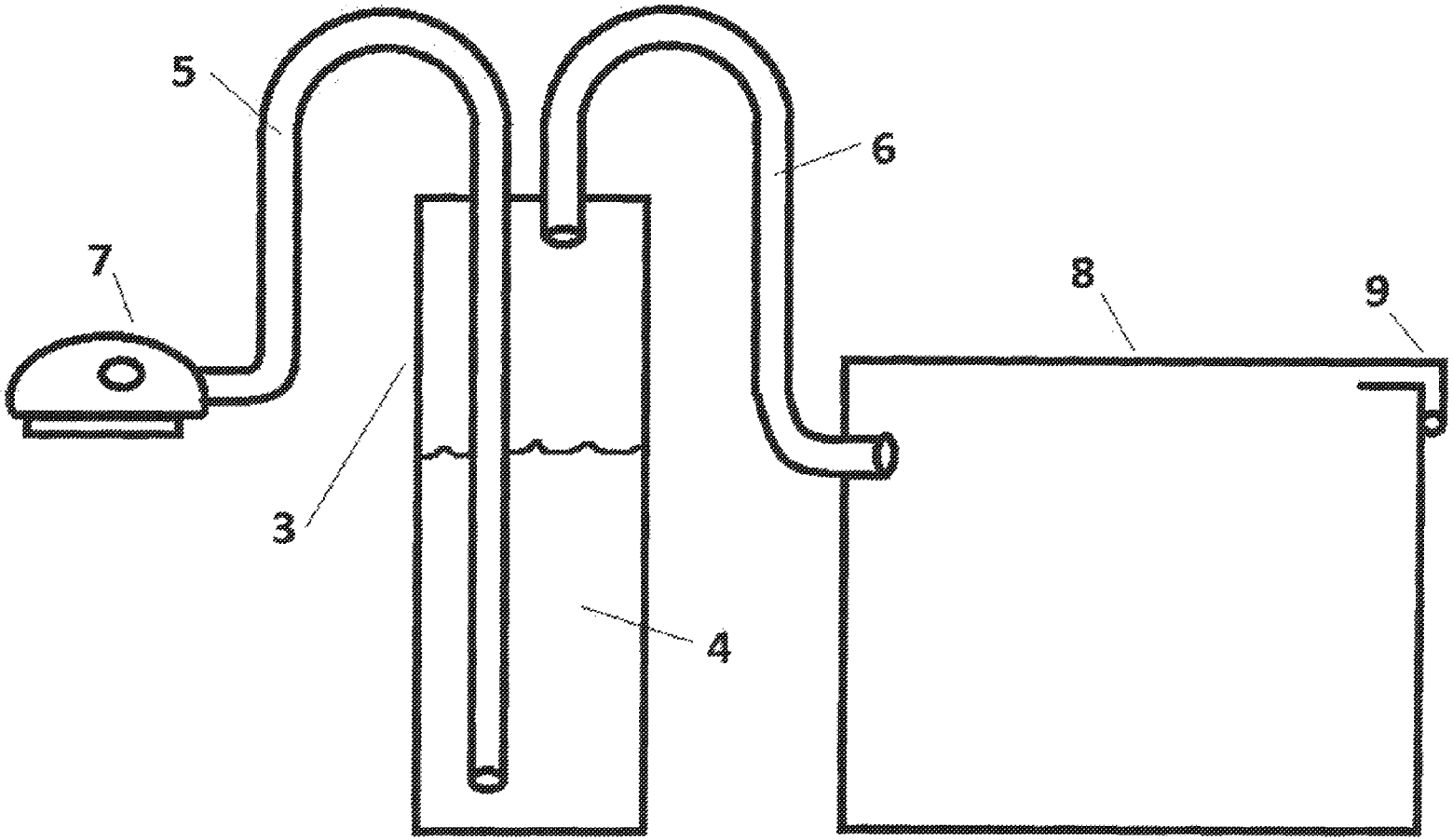
FIG. 1 shows an apparatus employing the disclosed method.
Figure 2:
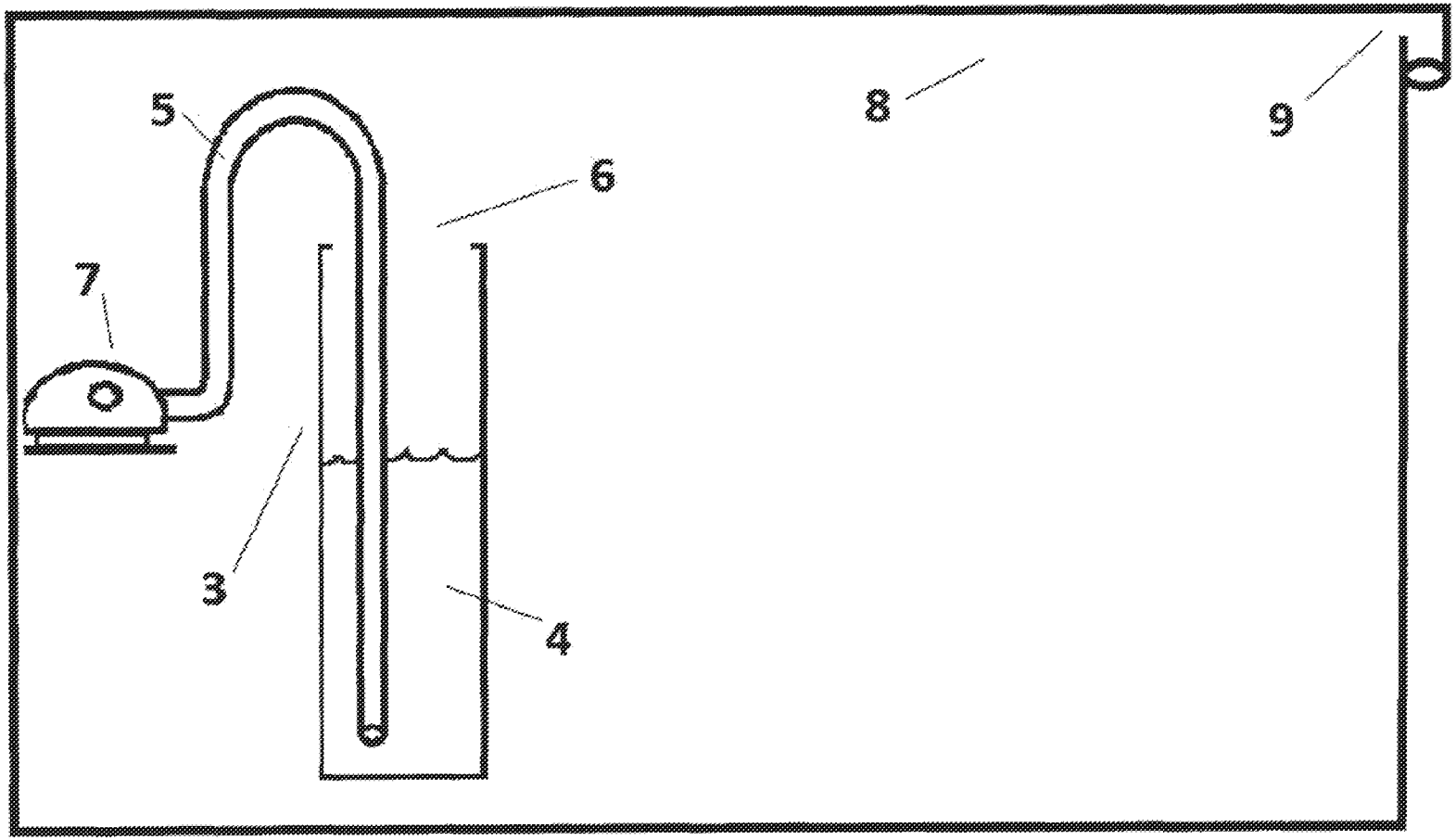
FIG. 2 shows an alternate configuration of the apparatus using a variation of component placement.

The drawings are provided to illustrate the interaction of individual components in an apparatus utilizing the disclosed method and to facilitate the understanding of the method in practice. The drawings are not intended to be exhaustive or to limit the invention to the precise form disclosed.

DETAILED DESCRIPTION OF THE INVENTION

The disclosed method of air humidification and injection delivery establishes and sustains a specific selected level of relative humidity in a container. The method practiced in the form of an apparatus uses a submerged blasting technique to facilitate ambient air through the liquid medium contained in the apparatus for humidification. The resulting humidified air exits the apparatus at a specific selected level of relative humidity determined by the composition of the liquid medium. The method and associated apparatus is designed to be used in conjunction with a container, wherein the humidified air is routed into said container. The selected relative humidity of the humidified air is thus established and maintained inside the container.

The method comprises the steps:

providing a liquid medium comprising a polyhydric alcohol substrate and water contained in a vessel, wherein the substrate exhibits hydrogen bonding properties with the water, and the specific substrate to water ratio is predetermined by the specific amount of moisture to be imparted on the submerged supply air;

submerging ambient supply air beneath the surface of a liquid medium for diffusion of moisture from the liquid medium into the submerged supply air, wherein the specific substrate to water ratio of the liquid medium determines the specific amount of moisture, in the form of percent relative humidity, imparted on the submerged supply air;

adjusting the substrate to water ratio of the liquid medium to select the specific relative humidity imparted on the submerged supply air;

routing humidified air released from the liquid medium for injection into a container having an exhaust ventilation port that restricts airflow to limit the escape of air from the container at a rate that does not exceed the entry rate of humidified air into the container to maintain a condition of positive pressure inside the container.

The liquid medium (4) in a preferred embodiment is a polyhydric alcohol substrate, specifically propylene glycol, and water, wherein the substrate exhibits hydrogen bonding properties with the water. The amount of moisture imparted on the supply air, and the subsequent relative humidity of the resulting humidified air, is determined by the substrate to water ratio of the liquid medium (4). An example; the liquid medium (4) comprising 70% propylene glycol and 30% water humidifies the submerged air to 75% relative humidity at room temperature. A second example; the liquid medium (4) comprising 75% propylene glycol and 25% water humidifies the submerged air to 71% relative humidity at room temperature. A third example; the liquid medium (4) comprising 67% propylene glycol and 33% water humidifies the submerged air to 78% relative humidity at room temperature. An increase or decrease of water content in the liquid medium (4) correlates to a relative increase or decrease in humidity transferred to the submerged air. The relative humidity of the resulting humidified air is selected by adjusting the substrate to water ratio of the liquid medium (4).

The method is practiced in the form of an apparatus, wherein the ambient supply air is facilitated into the vessel (3) through the inlet channel (5) by an air movement mechanism (7). In a preferred embodiment, the air movement mechanism (7) is an electrically operated pump. The inlet channel (5) extends from the air movement mechanism (7) into the vessel (3), terminating beneath the surface of the liquid medium (4) contained in the vessel (3). The supply air travels through the inlet channel (5) and for submersion in the liquid medium (4), wherein the surface area of said supply air is exposed to the liquid medium (4). Moisture from the liquid medium (4) diffuses into the submerged supply air, transforming the supply air into resulting humidified air.

The resulting humidified air is released from the liquid medium (4) as it bubbles to the surface of said liquid medium (4). Said resulting humidified air is purged from the vessel (3) through the outlet channel (6) as facilitated by the air movement mechanism (7) introducing supply air into the vessel (3) through the inlet channel (5). The outlet channel (6) extends from the vessel (3) and terminates inside the container (8), thus routing the humidified air for injection into the container (8).

The container (8) has an exhaust ventilation port (9) to relieve excess pressure from the container (8) while maintaining a condition of positive pressure inside the container (8). The exhaust ventilation port (9) is any route of airflow exit from the container (8), more specifically any opening that renders the container (8) not sealed. The exhaust ventilation port (9) restricts airflow to limit the escape of air from the container (8) at a rate that does not exceed the entry rate of resulting humidified air injected into the container (8). In a preferred embodiment, the exhaust ventilation port (9) is an inherent characteristic of the container (8), specifically the gap between the base and lid of said container (8).

Air in the container (8) is continually purged through the exhaust ventilation port (9) because of the incoming humidified air from the outlet channel (6), thus the relative humidity throughout the container (8) will be equivalent to the selected relative humidity of the injected humidified air. Contents of the container (8) are subsequently maintained at the selected relative humidity.

What is claimed is:

1. A method of humidifying air to a specific selected relative humidity to establish the selected relative humidity inside a container comprising the steps of:

submerging ambient supply air beneath the surface of a liquid medium for diffusion of moisture from the liquid medium into the submerged supply air;

providing the liquid medium comprising a polyhydric alcohol substrate and water contained in a vessel, wherein the substrate exhibits hydrogen bonding properties with the water, and the specific substrate to water ratio determines the specific amount of moisture imparted on the submerged supply air;

adjusting the substrate to water ratio of the liquid medium to select the specific relative humidity imparted on the submerged supply air;

routing humidified air released from the liquid medium for injection into a container having an exhaust ventilation port that restricts airflow to limit the escape of air from the container at a rate that does not exceed the entry rate of humidified air into the container to maintain a condition of positive pressure inside the container.

2. The method according to claim 1, wherein increasing or decreasing the water content in the liquid medium correlates to a relative increase or decrease in humidity transferred to the submerged air.

3. The method according to claim 1, wherein the humidification of the submerged air is performed using the liquid medium comprising 75% propylene glycol and 25% water for humidification of the submerged air to 71% relative humidity at room temperature.

4. The method according to claim 1, wherein the humidification of the submerged air is performed using the liquid medium comprising 70% propylene glycol and 30% water for humidification of the submerged air to 75% relative humidity at room temperature.

5. The method according to claim 1, wherein the humidification of the submerged air is performed using the liquid medium comprising 67% propylene glycol and 33% water for humidification of the submerged air to 78% relative humidity at room temperature.

* * * * *